US010812883B1

(12) United States Patent
Chargois

(10) Patent No.: US 10,812,883 B1
(45) Date of Patent: Oct. 20, 2020

(54) REVERSIBLE CABLE STORAGE POUCH WITH INTERNAL IN-LINE CATCHES

(71) Applicant: THE BANANA BUNGEE LLC, Katy, TX (US)

(72) Inventor: Trevor A. Chargois, Katy, TX (US)

(73) Assignee: THE BANANA BUNGEE LLC, Katy, TX (US)

( * ) Notice: Subject to any disclaimer, the term of this patent is extended or adjusted under 35 U.S.C. 154(b) by 0 days.

(21) Appl. No.: 16/388,431

(22) Filed: Apr. 18, 2019

Related U.S. Application Data

(60) Provisional application No. 62/661,240, filed on Apr. 23, 2018.

(51) Int. Cl.
*H04R 1/02* (2006.01)
*A45C 13/10* (2006.01)
*H04R 1/10* (2006.01)

(52) U.S. Cl.
CPC ..... *H04R 1/02* (2013.01); *A45C 13/10* (2013.01); *H04R 1/1033* (2013.01)

(58) Field of Classification Search
CPC .... H04R 1/1033; H04R 1/1016; A45C 7/0086
See application file for complete search history.

(56) References Cited

U.S. PATENT DOCUMENTS 6,026,961 A * 2/2000 McCarthy ..... G06F 1/1628 206/320
2003/0124948 A1* 7/2003 Ostolaza ..... A45C 9/00 446/75
2015/0121659 A1* 5/2015 Bacino ..... H04R 1/1033 24/16 R
2016/0261947 A1* 9/2016 Ito ..... H04R 1/1033

* cited by examiner

*Primary Examiner* — Sunita Joshi

(57) ABSTRACT

Disclosed is a reversible compact zipper earbud pouch with internal cable-catches comprised of a light-weight material design that remains unobtrusively attached to cabled devices such as an earbud listening device but not limited to same. The permanently attached cable-catches can open and securely bound various cables, collectively making it readily available during time of collection and bundling cable. Storage of same is kept self-contained, unobstructed and easily extracted from varied storage area.

20 Claims, 3 Drawing Sheets

REVERSIBLE CABLE STORAGE POUCH WITH INTERNAL IN-LINE CATCHES

CROSS-REFERENCE TO RELATED APPLICATIONS

This application claims benefit of and priority to, and incorporates herein by reference in its entirety, U.S. Provisional Application No. 62/661,240, filed Apr. 23, 2018, titled "REVERSIBLE COMPACT ZIPPER EARBUD POUCH WITH INTERNAL CABLE-CATCHES".

BACKGROUND

There are many examples of consumer products that involve the use of wires and cables. While in use, these wires or cables could be extended in an un-managed state. At some point those same wires or cables will have to be collected, bundled, stored and then extracted with ease for future use. This activity cuts across various work and recreational activities. And cable management is usually an afterthought. As used herein, the term "cable" may be used to refer to a wire used to facilitate an electronical connection (e.g. an auxiliary cable used to connect to a cell phone or any other auxiliary device such as a port to car audio system). As used herein, the term 'cable-catches' are used to define and describe the part of the invention used to open up and attach to wire or cables. With respect to earbud holders or containers; most enclosures remain a separate component. For the purpose of this disclosure we will focus on a sample activity and the cable, used as a main component, such as in the case of an earbud listening device. In this disclosure and example, the earbud cable facilitates the connection from the earbuds to any and all auxiliary devices (e.g., cell phones, computers or an assortment of other sound transmitting devices). Cables, as such, can be used to facilitate an assortment of electrical connections (e.g., providing power to various electrical devices).

Storing these device power-cords, auxiliary cables or wired earbud cables, such as in this sample usage, has been an ongoing struggle with varying development cycles. The exercise usually envisioned and or applied at the point of storage is one of manually coiling cable to-and-fro until most has been collected together. This is followed by wrapping that cable collection with a small but strategic length of cable held back specifically for this purpose. There are other commercially produced third-party wraps or ties to assist in this final wrapping process. Other commercial products, with limiting factors of their own, would include self-coiling components.

Third-party wrap solutions can be in the form of separate Velcro or plastic zip-ties. The act of obtaining or securing these third-party wraps is accomplished by keeping them in proximity to the collection activity or in some cases they could be affixed in some form to the wire itself. Once bundling has been achieved the cables and or devices must be stored. The storage process is usually confronted with keeping or maintaining the wires properly bound during storage. The gathered cable is stored in a pocket, purse, drawer, backpack, etc. This is usually followed by the extraction process from its stored state. It is usually met with the need to uncover or remove objects that have been piled on top. The 3rd party wraps or ties still fail to keep the bundle compact and self-contained allowing other items stored with them to become entangled. Therein posing yet another problem during the extraction from storage. Third party external tie mechanisms and self-coiling designs are also available to help consumers collect, bundle and bound the cable. However, while self-coiling components reduce the requirements for 3rd party ties or wraps, they introduce an internal-coil capable of wearing-out our malfunctioning.

Accordingly, there is a need for a solution to the conundrum of effectively and efficiently storing and utilizing cable-based device (such as earbuds) given that solutions available today are inadequate.

SUMMARY

Disclosed herein are various implementations of a reversible cable storage pouch with internal in-line catches that remains in-line with the cable and unobtrusive when in use. Certain such implementations may be specifically directed to a reversible compact zipper earbud pouch having internal cable-catches. These various implementations become an attachable but then complete integral or connected part of the cable while at the same time keeping all needed implements within instant proximity. In this manner, the various implementations help achieve a flexible attachment mechanism for various devices such as earbuds while providing a manageable collection process, clean storage, and easy extraction.

This summary is provided to introduce a selection of concepts in a simplified form that are further described below in the detailed description. This summary is not intended to identify key features or essential features of the claimed subject matter, nor is it intended to be used to limit the scope of the claimed subject matter.

BRIEF DESCRIPTION OF THE DRAWINGS

The foregoing summary and the following detailed description of illustrative implementations are better understood when read in conjunction with the appended drawings. For the purpose of illustrating the implementations, there is shown in the drawings example constructions of the implementations; however, the implementations are not limited to the specific methods and instrumentalities disclosed. In the drawings.

DETAILED DESCRIPTION

Disclosed herein are various implementations of a reversible compact pouch used to facilitate easy storage and retrieval of earbuds where the pouch remains an integral part of the earbud cable while in use in a manner facilitated by cable-catches that are permanently affixed within the lightweight stretchable fabric. By reversing onto the bundled earbud cable and zipped closed, controlled storage is achieved. Various concepts helpful to more fully understand and appreciate these various implementations are herein described in support of the disclosures specifically pertaining to these various implementations that follow.

In summary, the various implementations disclosed herein enable cable-based consumer devices (such as earbuds) that require said cables to be extended during use with the ability to collect, effectively store, and later retrieve when needed said cables, all without the need for third party components. More specifically, disclosed is a reversible compact zipper earbud pouch with internal cable-catches comprised of a light-weight material design that remains unobtrusively attached to cabled devices such as an earbud listening device but not limited to same. The design is compact and comprises material is both light-weight and stretchable. The light-weight fabric facilitates the device being unobtrusive during usage. While stretchable fabric helps it be both unobtrusive and totally envelopes the desired cable or cabled device all within a compact pouch. The permanently attached cable-catches can open and securely bound various cables; collectively making it readily available during time of collection and bundling cable. Storage of same is kept self-contained, unobstructed an easily extracted from varied storage area.

As such, the various implementations disclosed herein may comprise a stretchable lightweight fabric forming a compact pouch. The internal lower-ribbed seam of the pouch having two permanently affixed cable-catches designed to open and attach to the earbud cable. The pouch is also designed to be reversible and configured with a zipper to enable easy opening and reversing (exposing the storage area within), exposing the inner seam and pocket area for bundled cable and then closing (securely wrapping and holding the contents—wire or cable). The pouch size can be designed and made in differing sizes and with specific tolerances depending upon activity or device-cable requirements. It is a light-weight material design that remains unobtrusive during cable use and is readily at hand during time of collection and storage. As it completely wraps the cable, the flexible/stretchable zippered enclosure keeps the earbud cable self-contained and safe from entanglement.

Figure 1:
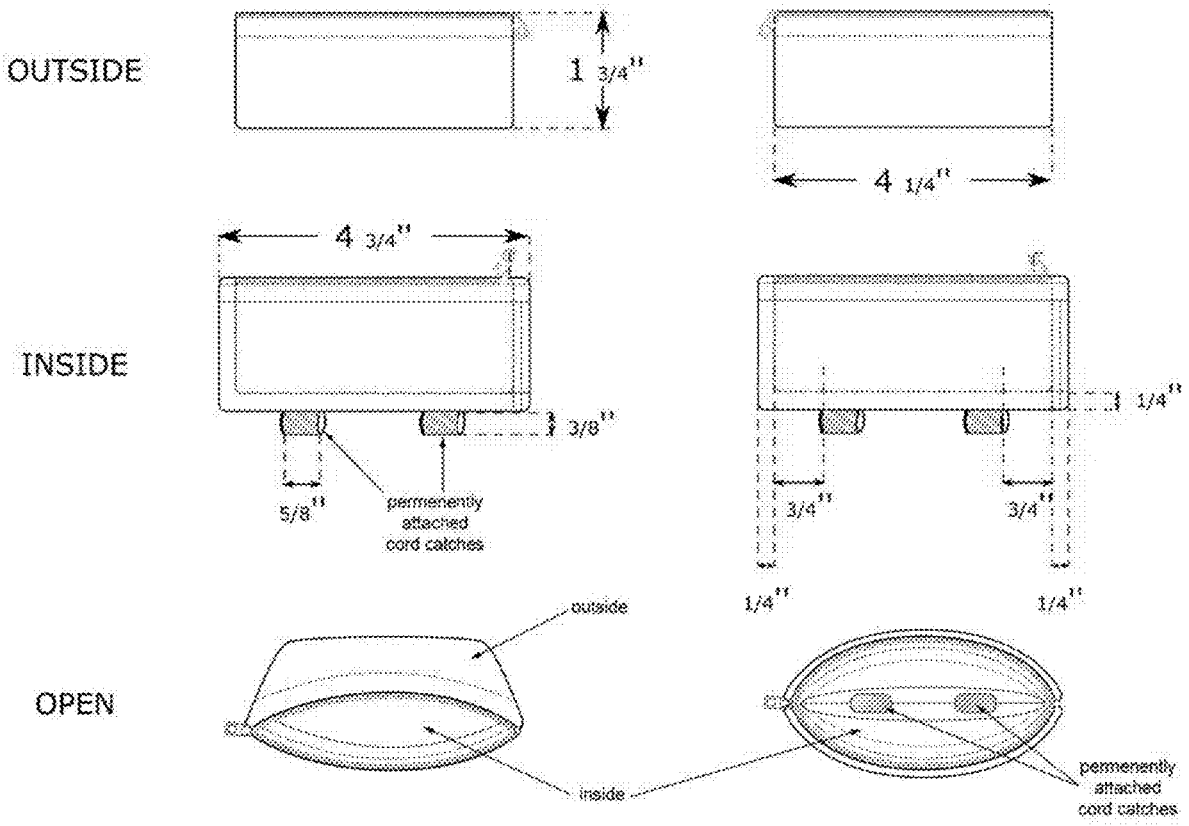
FIG. 1 is a simple drawing providing dimensions and different views of the pouch, is a simple drawing providing both dimensions and inside-out view of the compact pouch, and wherein the pouch as pictured may be zippered shut.

FIG. 1 is a simple drawing providing dimensions and different views of the pouch; is a simple drawing providing both dimensions and inside-out view of the compact pouch; pouch, as pictured, is zippered shut and illustrated here inside-out. Of importance is the view this perspective provides. Note that the length over-all is approximately one-half inch longer. This is due to the internal seems being exposed. Also of note and coming into view are the permanently-attached cord-catches. The simple drawing of FIG. 1 also provides a perspective of the pouch now displayed in an open state; both zipper opening and from top-down.

Figure 2:
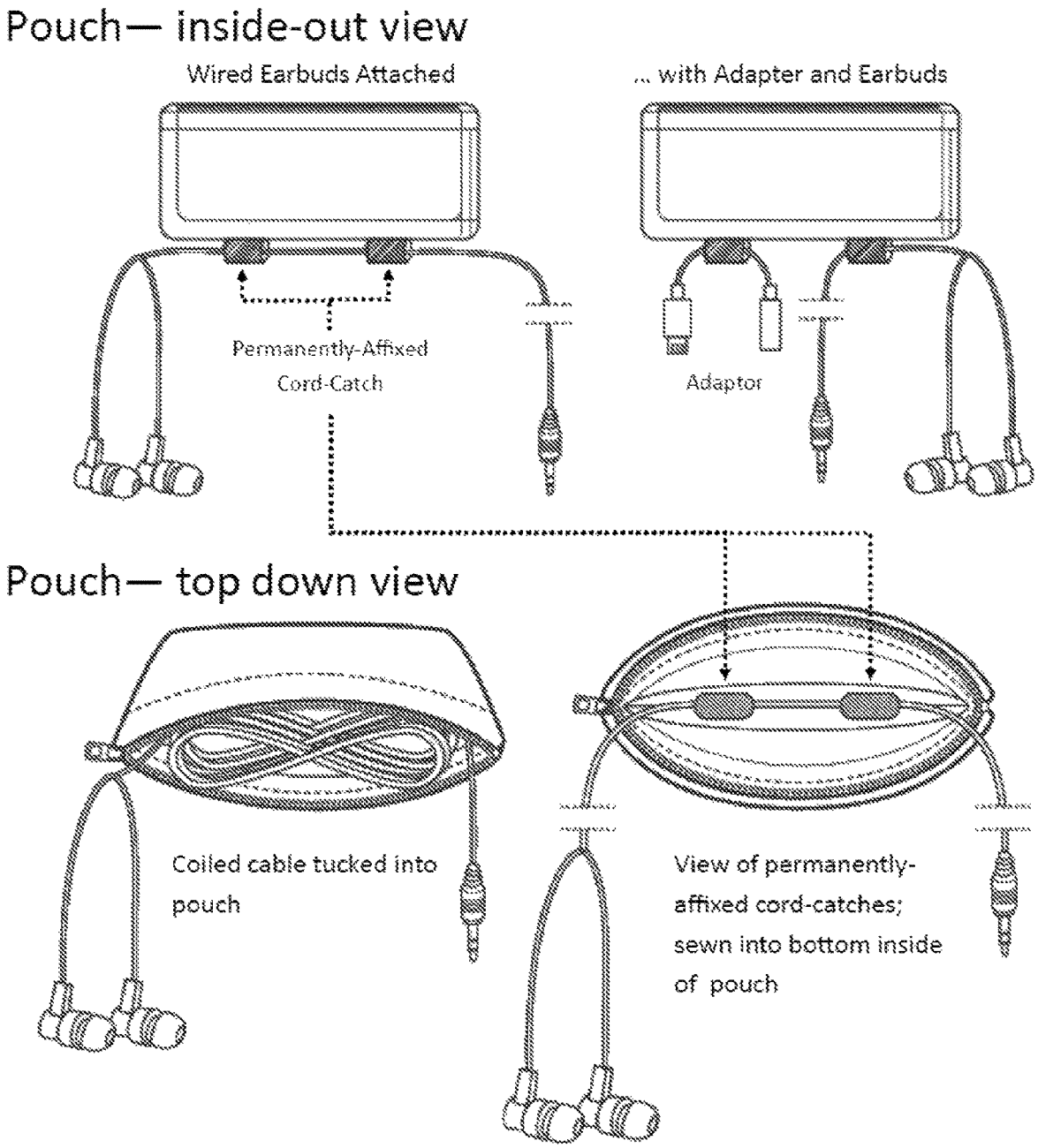
FIG. 2 comprises drawings illustrating pouch with cable attachments.

FIG. 2 presents drawings illustrating pouch with cable attachments. Pouch is illustrated inside-out with cable attachments, and also illustrates a complete earbud component. (Visible hash-lines represent cable length missing due to illustration limitations.) The Figure also illustrates an adapter connected to one permanently attached cable-catches and complete earbud component attached to the other permanently attached cable-catch. (Visible arrows represent cable length missing due to illustration limitations.) The Figure further illustrates look inside the pouch with cable attachments, when pouch is open with a complete earbud component bundled inside but not zippered closed, and when a top-down view of an open pouch; a complete earbud component attached to both permanently-attached-cable-catches along the lower seam of the pouch.

Figure 3:
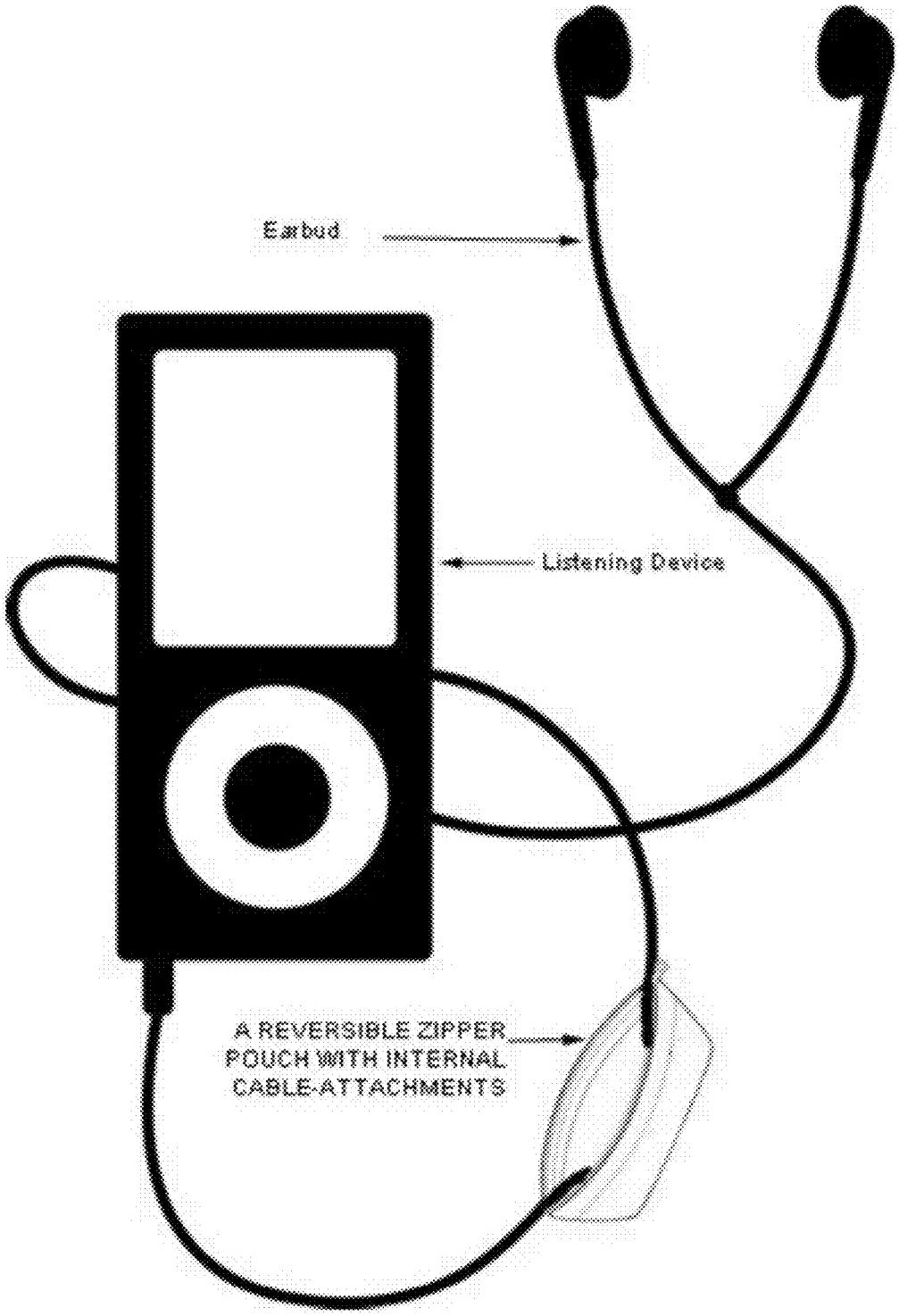
FIG. 3 illustrates a reversible compact zipper earbud pouch with internal cable-catches being used as a complete integral part of an earbud cable assembly.

FIG. 3 illustrates a reversible compact zipper earbud pouch with internal cable-catches being used as a complete integral part of an earbud cable assembly.

Disclosed herein is compact textile design; a zippered reversible pouch. The pouch is constructed of a stretchable and lightweight material that attaches to earbud cables via permanently affixed cable-catches. The dual cable-catches enable attachment to a single earbud cable or in the case where small adaptor (pigtail cable components) are required; one catch can be used for the adaptor while the other catch maintains connection to the main earbud cable. The pouch becomes an integral part of the cable while remaining unobtrusive during use due to its lightweight and compact size. The pouch is designed to ease earbud cable management and simplified storage by using the reversible feature to completely envelop the earbud and associated cable(s) using the zipper closure.

Various alternative implementations may feature the following: (1) a compact textile design; zippered reversible pouch comprised of stretchable lightweight material to facilitate an unobtrusive attachment to earbud cable; (2) zippered, reversible and stretchable to ease collection of cable and completely envelop the desired cabled attachment; (3) two internally and permanently attached cable-catches; capable attaching to and holding an individual cable or two separate cable components; and/or (4) successfully and completely enveloping the cable component within the disclosed invention; prevents entanglement with other stored objects.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims. Moreover, the phrase "based on" does not mean "based only on," unless expressly specified otherwise. In other words, the phrase "based on" describes both "based only on" and "based at least on," or, if supported by the context, "based permissibly on."

Moreover, the flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure. As such, it should be noted that one or more of the features, functions, procedures, components, elements, structures, etc., described in connection with any one of the configurations, implementations, examples, or embodiments described herein may be combined with one or more of the functions, procedures, components, elements, structures, etc., described in connection with any of the other configurations, implementations, examples, or embodiments described herein, where compatible. In other words, any compatible combination of the functions, procedures, components, elements, etc., described herein may be implemented in accordance with the systems and methods disclosed herein.

Furthermore, unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose."

Any incorporation by reference of a portion of a document shall also be understood to incorporate definitions of terms or variables that are referenced within the portion, where such definitions appear elsewhere in the document, as well as any figures referenced in the incorporated portion. Unless initially introduced by a definite article, an ordinal term (e.g., "first," "second," "third," etc.) used to modify a claim element does not by itself indicate any priority or order of the claim element with respect to another, but rather merely distinguishes the claim element from another claim element having a same name (but for use of the ordinal term). Unless expressly limited by its context, each of the terms "plurality" and "set" is used herein to indicate an integer quantity that is greater than one, whereas the term "subset" is used herein to indicate an integer quantity that is greater than or equal to one. Furthermore, in the above description reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular figure.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but is to be accorded the widest scope consistent with the principles and novel features disclosed herein. Furthermore, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims that follow.

What is claimed:

1. An apparatus comprising a reversible pouch comprising stretchable lightweight material and unobtrusive attachments for an earbud cable, such that said pouch is capable of completely enveloping the earbud cable, and said attachments being capable of engaging and disengaging the earbud cable without requiring either end of the earbud cable to pass through or make contact with said attachments for said attachments to engage said earbud cable.

2. An apparatus comprising a reversible pouch having two internally and permanently attached cable-catches capable of attaching to and holding an individual cable component or two separate cable components, said pouch is capable of completely enveloping the desired cabled components, and said cable-catches being capable of engaging and disengaging a cable of the cable component without requiring the ends of the cable to pass through said cable-catches.

3. An apparatus comprising a reversible pouch comprising stretchable lightweight material and two or more internal, unobtrusive, and permanently attached cable-catches capable of attaching to and holding an individual cable component for two or more separate cable components such as earbud cables, said pouch further capable of completely enveloping the desired cabled components, and each of said cable-catches being capable of engaging and disengaging a cable of the corresponding cable component without requiring the ends of the cable to pass through said cable-catches.

4. The apparatus of claim 1 wherein the reversible pouch capable of providing a maximum storage volume for storing the earbud cable therein, and also capable of achieving said maximum storage volume even when said earbud cable is fully deployed for use while coupled to said attachments.

5. The apparatus of claim 1 wherein the attachments comprise hook-and-loop fasteners.

6. The apparatus of claim 1 wherein the attachments are separate and distinguishable from each other and from the reversible pouch.

7. The apparatus of claim 1 wherein the reversible pouch is a zippered reversible pouch.

8. The apparatus of claim 1 wherein the zippered reversible pouch is capable of storing both ends of the earbud cable, and any terminal components physically coupled to said ends, when said attachments are engaged to said earbud cable.

9. The apparatus of claim 1 wherein the attachments are capable of separately and simultaneously engaging more than one cabled item.

10. The apparatus of claim 2 wherein the reversible pouch capable of providing a maximum storage volume for storing one or more cable components therein, and also capable of achieving said maximum storage volume even when said cable components are deployed for use while coupled to said cable-catches.

11. The apparatus of claim 2 wherein the cable-catches comprise hook-and-loop fasteners.

12. The apparatus of claim 2 wherein the attachments are separate and distinguishable from each other and from the reversible pouch.

13. The apparatus of claim 2 wherein the reversible pouch is a zippered reversible pouch.

14. The apparatus of claim 2 wherein the zippered reversible pouch is capable of storing both ends of the cable of the cable components, and any terminal components physically coupled to said ends of the cable, when said attachments are engaged to said cable components.

15. The apparatus of claim 2 wherein the reversible pouch is a zippered pouch comprises a stretchable lightweight material.

16. The apparatus of claim 3 wherein the reversible pouch capable of providing a maximum storage volume for storing at least one cable component therein, and also capable of achieving said maximum storage volume even when said at least one cable component is deployed for use while coupled to said cable-catches.

17. The apparatus of claim 3 wherein the cable-catches comprise hook-and-loop fasteners.

18. The apparatus of claim 3 wherein the attachments are separate and distinguishable from each other and from the reversible pouch.

19. The apparatus of claim 3 wherein the reversible pouch is a zippered reversible pouch.

20. The apparatus of claim 3 wherein the zippered reversible pouch is capable of storing both ends of the cable for each of one or more the cable components, and any terminal components physically coupled to said ends of the cable, when said attachments are engaged to said corresponding cable component.

* * * * *